US005182900A

United States Patent [19]

Horak et al.

[11] Patent Number: 5,182,900

[45] Date of Patent: Feb. 2, 1993

[54] METHOD AND APPARATUS FOR CHECKING THE OPERATION OF A PNEUMATIC SPLICER

[75] Inventors: Dieter Horak, Mönchengladbach; Hans-Heinz Schäfer, Schwalmtal, both of Fed. Rep. of Germany

[73] Assignee: W. Schlafhorst AG & Co., Mönchengladbach, Fed. Rep. of Germany

[21] Appl. No.: 863,506

[22] Filed: Mar. 31, 1992

Related U.S. Application Data

[63] Continuation of Ser. No. 632,547, Dec. 24, 1990, abandoned.

[30] Foreign Application Priority Data

Dec. 23, 1989 [DE] Fed. Rep. of Germany ..... 3942864

[51] Int. Cl.[5] ..... D01H 13/26; G01F 15/18

[52] U.S. Cl. ..... 57/22; 57/264; 57/265; 57/350; 73/118.2; 73/201

[58] Field of Search ..... 57/264, 265, 22, 350, 57/333; 73/118.2, 201, 865.9, 714

[56] References Cited

U.S. PATENT DOCUMENTS

| | | | |
|---|---|---|---|
| 4,344,277 | 8/1982 | Rohner et al. | 57/22 |
| 4,397,139 | 8/1983 | Wey et al. | 57/22 |
| 4,438,621 | 3/1984 | Rohner | 57/333 X |
| 4,577,458 | 3/1986 | Garnsworthy | 57/22 |
| 4,765,128 | 8/1988 | Rosen et al. | 57/22 |
| 4,774,833 | 10/1988 | Weibler et al. | 73/118.2 |
| 4,858,467 | 8/1989 | Weng | 73/714 X |
| 4,976,145 | 12/1990 | Kienzle et al. | 73/118.2 X |

FOREIGN PATENT DOCUMENTS

| | | | |
|---|---|---|---|
| 3033050 | 1/1989 | Fed. Rep. of Germany . | |
| 2041421 | 2/1990 | Japan | 57/264 |

*Primary Examiner*—Daniel P. Stodola
*Assistant Examiner*—William Stryjewski
*Attorney, Agent, or Firm*—Herbert L. Lerner; Laurence A. Greenberg

[57] ABSTRACT

A method for checking operation of a pneumatic splicer for joining two yarn ends at a textile machine includes feeding splicing gas for a predetermined period of time to a splicer to be checked for splicing a particular yarn batch without having yarn ends laid in place in a splicing conduit of a splicer head of the splicer to be checked. At least one status variable of outflowing splicing gas is measured during the predetermined period of time at a given opening in the splicer head. A reference value is measured at another splicer producing replicable spliced joints meeting a previously defined quality and being identical to the splicer being checked, by feeding splicing gas to the other splicer without yarn ends being laid in place in the splicing conduit and measuring the reference value at a given opening in the splicer head. The at least one status variable is compared with the measured reference value and deviations are ascertained. The magnitude of the deviations is used as a basic criterion for evaluating the operation of the splicer to be checked, and satisfactory operation of the checked splicer is then resumed. An apparatus for checking the operation of the pneumatic splicer includes a test apparatus having a splicing gas carrier in the form of a measuring tube. The measuring tube carries an adaptor for connecting the measuring tube to one of the splicer heads and includes a device for detecting at least one status variable of the splicing gas.

21 Claims, 4 Drawing Sheets

Section II-II 50
51a
51b
51c
51d
51e
52a
52b
52c
52d
52e
53
54
55
56
20
21
21a
22
23
24
25
26
26a
27
28
29
30
30a
31
32
33
34
9c
10c
11c
12
16c
101
102a
102b
103
104

METHOD AND APPARATUS FOR CHECKING THE OPERATION OF A PNEUMATIC SPLICER

This application is a continuation of application Ser. No. 632,547, filed Dec. 24, 1990, now abandoned.

The invention relates to a method and apparatus for checking or testing the operation of a pneumatic splicer for joining two yarn ends in a textile machine, preferably a bobbin spinning machine.

Joining two yarn ends using splicing gas at high pressure in a pneumatic splicer is successful and leads to a good outcome only if the splicing gas flows into the splicing conduit or channel with the necessary pressure at the desired and previously established time. During thermal splicing, it must furthermore be assured that the temperature of the splicing gas is at the desired temperature when it enters the splicing conduit.

An apparatus for assuring the quality of spliced joints of textile yarns in a controllable compressed air splicer is already known from German Patent DE-PS 30 33 050. The quality assurance apparatus known from the prior art has a pressure monitor which is provided with an adjusting device for minimum pressure and/or tolerance limits of a pressure reservoir. If the pressure necessary for a good splicing outcome in a splicing procedure is inadequate, an alarm is sounded and/or the compressed air splicer automatically shuts off.

The monitoring function of the quality assurance apparatus is limited to merely monitoring the central compressed air source. However, such an apparatus cannot be used to check whether or not the set pressure in fact prevails in each individual splicing conduit, and whether or not the duration of the period during which the splicing gas flows in, indeed prevails. Even a loosely seated splicer head, a pressure that is wrongly set by mistake at a particular splicer, and soiled inlet openings for the splicing gas into the splicing conduit, can negatively affect the outcome of splicing, without the known quality assurance apparatus responding to such a fact and shutting down the malfunctioning splicer.

It is accordingly an object of the invention to provide a method and an apparatus for checking the operation of a pneumatic splicer, which overcome the hereinafore-mentioned disadvantages of the heretofore-known methods and devices of this general type and with which the operation of a pneumatic splicer can be checked simply, reliably and quickly.

With the foregoing and other objects in view there is provided, in accordance with the invention, a method for checking the operation of a pneumatic splicer having a splicer head with a splicing conduit for joining two yarn ends at a textile machine, which comprises feeding splicing gas for a predetermined period of time to a splicer to be checked for splicing a particular yarn batch without having yarn ends laid in place in the splicing conduit of the splicer head of the splicer to be checked; measuring at least one status variable of outflowing splicing gas during the predetermined period of time at a given opening in the splicer head; measuring a reference value at another splicer producing replicable spliced joints meeting a previously defined quality and being identical to the splicer to be checked, by feeding splicing gas to the other splicer without yarn ends being laid in place in the splicing conduit and measuring the reference value a given opening in the splicer head; comparing the at least one status variable with the measured reference value and ascertaining deviations; using the magnitude of the deviations as a basic criterion for evaluating the operation of the splicer to be checked; and then resuming satisfactory operation of the checked splicer.

In accordance with another mode of the invention, there is provided a method which comprises measuring the pressure building up upon outflow of the splicing gas at the given opening in the splicer head as the at least one status variable, by positioning splicing gas carrying means at the given opening, delivering the splicing gas to a pressure measuring instrument, and comparing the measured value with a reference value.

In accordance with a further mode of the invention, there is provided a method which comprises measuring the flow speed of the outflowing splicing gas at the given opening in the splicer as the status variable, by positioning splicing gas carrying means at the given opening, delivering the splicing gas to an instrument for measuring the flow speed, and comparing the measured value with a reference value.

In accordance with an added mode of the invention, there is provided a method which comprises measuring the temperature of the outflowing splicing gas at the given opening in the splicer head as the status variable, by positioning splicing gas carrying means at the given opening, delivering the splicing gas to a temperature measuring instrument, and comparing the measured value with a reference value.

In accordance with an additional mode of the invention, there is provided a method which comprises simultaneously measuring at least two status variables of the splicing gas selected from the group consisting of the pressure building up, the flow speed and the temperature of the outflowing splicing gas at the given opening in the splicer head, by positioning splicing gas carrying means at the given opening, carrying the splicing gas to instruments for measuring the status variables, and comparing the at least two status variables with the reference values associated with the at least two status variables.

In accordance with again another mode of the invention, there is provided a method which comprises additionally measuring the temperature of the splicer head.

When two yarn ends are joined by means of a pneumatic splicer, the duration of the splicing procedure and the pressure that should prevail in the feed line leading to the splicer are set as a function of the yarn parameters of a particular yarn batch. When splicing with heated splicing gas, which is known as thermal splicing, the temperature of the splicing gas must also be accurately set. Even today, the determination of the splicing parameters of pneumatic splicers for splicing specific yarns can only be ascertained through an expensive series of tests. It is therefore particularly important for the setting variables, that is the pressure of the splicing gas, the duration of the inflow and if applicable, the temperature, to be maintained continuously once set. Even if these set variables have already been set at each splicer, this does not assure that the same conditions will prevail, and in particular not while under pressure and at the proper temperature, in the splicing conduit of the splicer head of every splicer during every splicing procedure.

Therefore, with the method according to the invention, the status variables of the splicing gas are measured after it exits from the splicing conduit, and not prior to its entry into the splicing conduit. As compared with known checking methods, the method of the invention has the advantage of measuring the status variables at the point where they have an effect and where they are intended to assume the necessary value. To this end, the status variables should always be measured at the same points at an opening in the measurement head having the splicing conduit.

Therefore, the splicing gas carrying means, such as a measuring tube, are connected to the opening for carrying the compressed gas to the means for measuring the status variables.

The pressure, the flow speed of the outflowing splicing gas and if applicable the temperature, are the status variables that can be measured upon the emergence of the splicing gas into the splicing conduit, and which can also provide adequate information as to the operation of the applicable splicer. The status variables of the splicing gas that are to be checked are ascertained beforehand for a splicer that is then used as the reference apparatus. To this end, the reference splicer is actuated for a previously defined period of time without any yarn to be spliced having been placed therein. The measurement results thus obtained are used as reference values.

The checks can then be performed for splicers of identical construction. In order to do so, the procedure is exactly as in the measurement of the status variables for the reference splicer. With the yarn ends not placed therein, the splicer is actuated for the previously fixed duration, which is the same as for the measurement of the reference splicer. During this time, at least one of the status variables of the outflowing splicing gas is measured. The measured value obtained is compared with the measured valued obtained for the reference splicer. The magnitude of the deviation ascertained upon comparison of the measured values is used as a basic criterion for evaluating the operation of the splicer being checked. It is advantageously possible to determine which splicers are malfunctioning and what type of malfunction is involved, from the differences between the measured values and the reference measured values. For instance, if pressure differences or differences in the flow speed of the outflowing splicing gas are ascertained, then either the pressure has been incorrectly set at the setting valve of the splicer, or the splicer head has come loose, allowing leakage. It is also possible that dirt may have settled in the compressed air injection openings. The source of the problem can thus be found easily, even with the naked eye. If the outflowing splicing gas at a splicer is not at the requisite splicing temperature then, for instance, the heater of the splicer head may have failed.

The method according to the invention is suitable not only for recognizing and correcting defective operation of a splicer but is advantageously also suitable for preventive maintenance of the splicers. If the splicers on the textile machines are checked regularly by the method according to the invention, then even reductions in the quality of the operation of the splicers that have not yet caused serious deficiencies in the spliced joints can be recognized early and taken care of.

If the status variables for a splicer do not match the predetermined reference values, then it can not only be assumed that the operation of the pneumatic splicer is poor but also that the outcomes of splicing do not meet requirements.

Through the use of the method of the invention, the status variables can be measured either individually or in an arbitrary combination with one another. For instance, the pressure that builds up upon outflow of the splicing gas can be measured along with the temperature of the splicing gas. However, it is also possible to measure the flow speed of the outflowing splicing gas combined with its temperature. In so-called thermal splicing, it is also advantageous to monitor the temperature of the splicer head. If a splicer head does not have its own thermal element for monitoring its temperature, then according to the method of the invention a temperature measurement can be performed at the splicer head, in addition to the temperature measurement of the splicing gas.

In order to enable easy processing of the measured values being produced and comparison with the reference values, it is advantageous to enter the measured values directly into a computer. The measured values can be stored in memory there, so that information is, for instance, obtainable as to the operation of all the splicers of one machine. At the same time, storing the measured values in memory offers the opportunity of comparing them with the reference values. A computer also advantageously offers the opportunity of representing the measured values in the form of tables or diagrams. As a result, it is easy to clearly show which of the pneumatic splicers is deviating in its operation from the required operation. Additionally, possible sources of error or defects can be isolated, and the measures necessary for restoring proper operation can be taken.

With the objects of the invention in view there is also provided, in a pneumatic splicer having a splicer head with a splicing conduit for joining two yarn ends at a textile machine, an apparatus for checking the operation of the pneumatic splicer, comprising a test apparatus having splicing gas carrying means in the form of a measuring tube; and an adaptor carried by the measuring tube for connecting the measuring tube to one of the splicer heads of the splicers; the measuring tube including means for detecting at least one status variable of the splicing gas.

In accordance with another feature of the invention, the detecting means are in the form of a pressure pickup and/or a flow rate meter for gas and/or a temperature sensor.

In accordance with a further feature of the invention, the detecting means are in the form of at least two means for detecting at least two different status variables of the splicing gas selected from the group consisting of the pressure building up, the flow speed and the temperature of the outflowing splicing gas.

In accordance with an added feature of the invention, the measuring apparatus has a further temperature sensor for measuring the temperature of the splicer head.

In accordance with an additional feature of the invention, there are provided signal lines connected to the detecting means, and a computer connected to the signal lines for displaying and storing at least one measured value in memory and comparing the at least one measured value with at least one respective predetermined reference value.

In accordance with yet another feature of the invention, the adaptor has means for connecting the measuring tube to different splicer heads of various splicers.

In accordance with yet a further feature of the invention, the adaptor is interchangeable.

In accordance with yet an added feature of the invention, the adaptor is formed of a material with low thermal conductivity.

In accordance with yet an additional feature of the invention, there are provided means disposed upstream of the flow rate meter for canceling a spin of the splicing gas in the measuring tube.

In accordance with a concomitant feature of the invention, there is provided a metal sheet oriented in the longitudinal direction of the measuring tube for enlarging the area of contact with the gas flow, the temperature sensor for the splicing gas being secured to the metal sheet.

Other features which are considered as characteristic for the invention are set forth in the appended claims.

Although the invention is illustrated and described herein as embodied in a method and apparatus for checking the operation of a pneumatic splicer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figures 2, 2A:
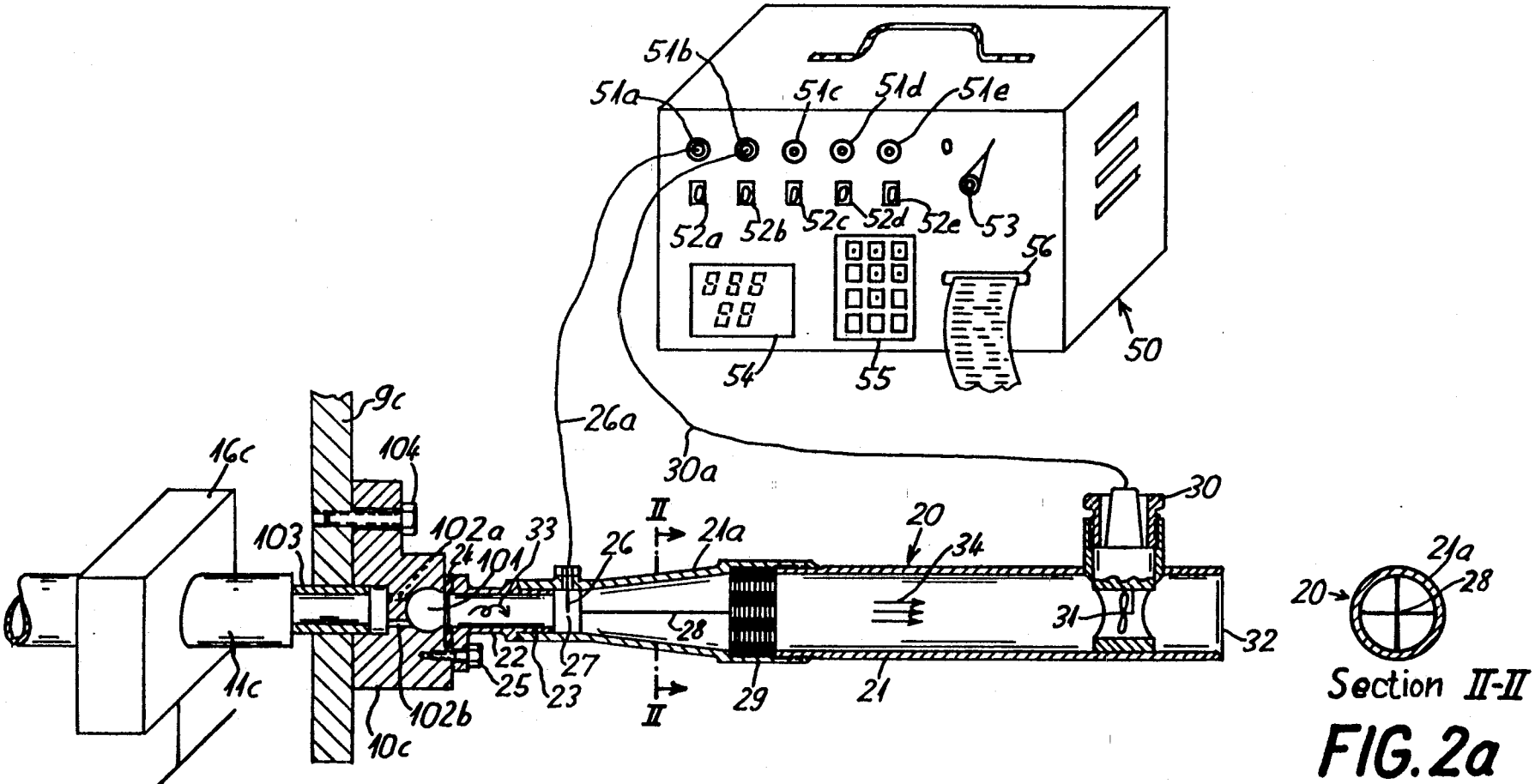
FIG. 2 is a fragmentary, partly perspective and partly longitudinal-sectional view showing the structure of an apparatus according to the invention for measuring the temperature and flow speed of splicing gas.
Figure 3:
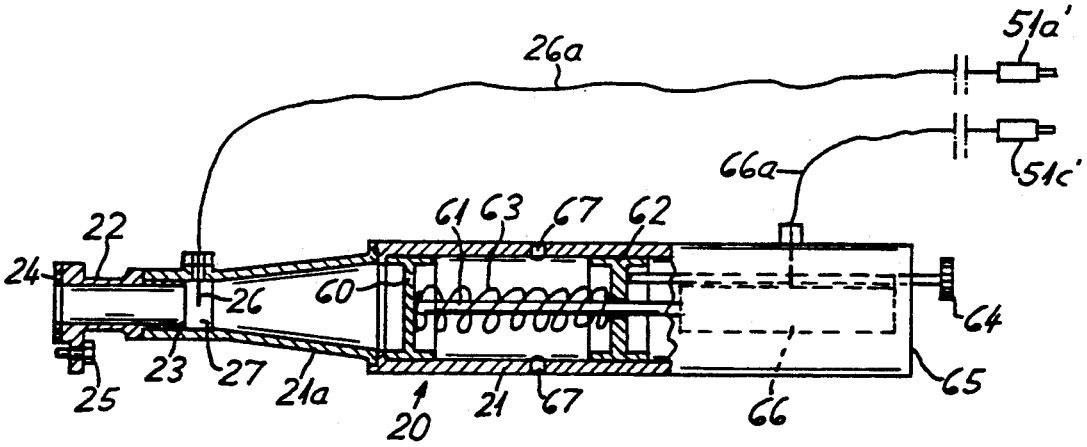
Figure 4:
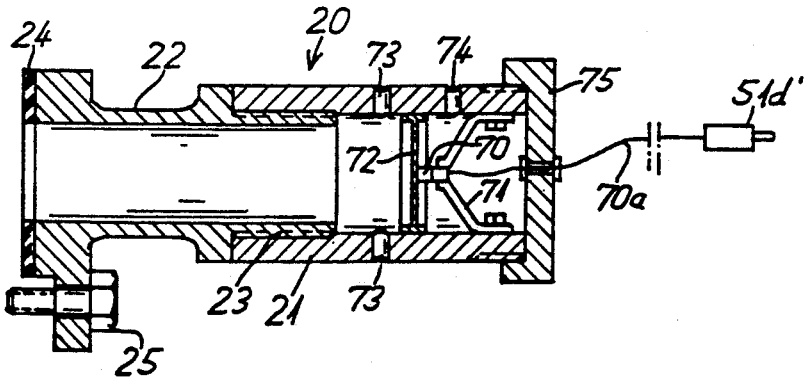
Figure 5:
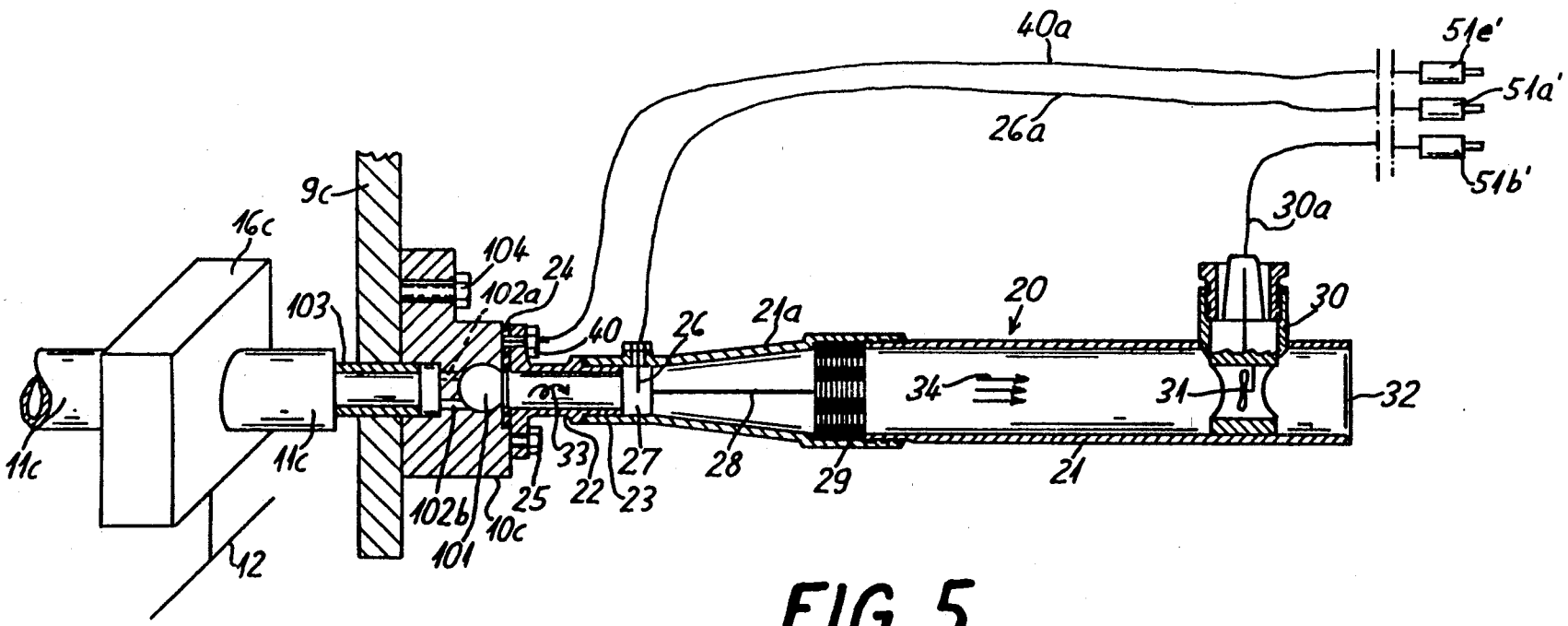

FIG. 2*a* is a cross-sectional view taken along the line II—II of FIG. 2, in the direction of the arrows;

FIG. 3 is a longitudinal-sectional view of an apparatus for measuring the temperature and pressure of a splicing gas;

FIG. 4 is a longitudinal-sectional view of a further embodiment of an apparatus for measuring the pressure; and FIG. 5 is view similar to the lower portion of FIG. 2 showing an embodiment having an additional temperature sensor for measuring the temperature of the splicer head.

Figure 1:
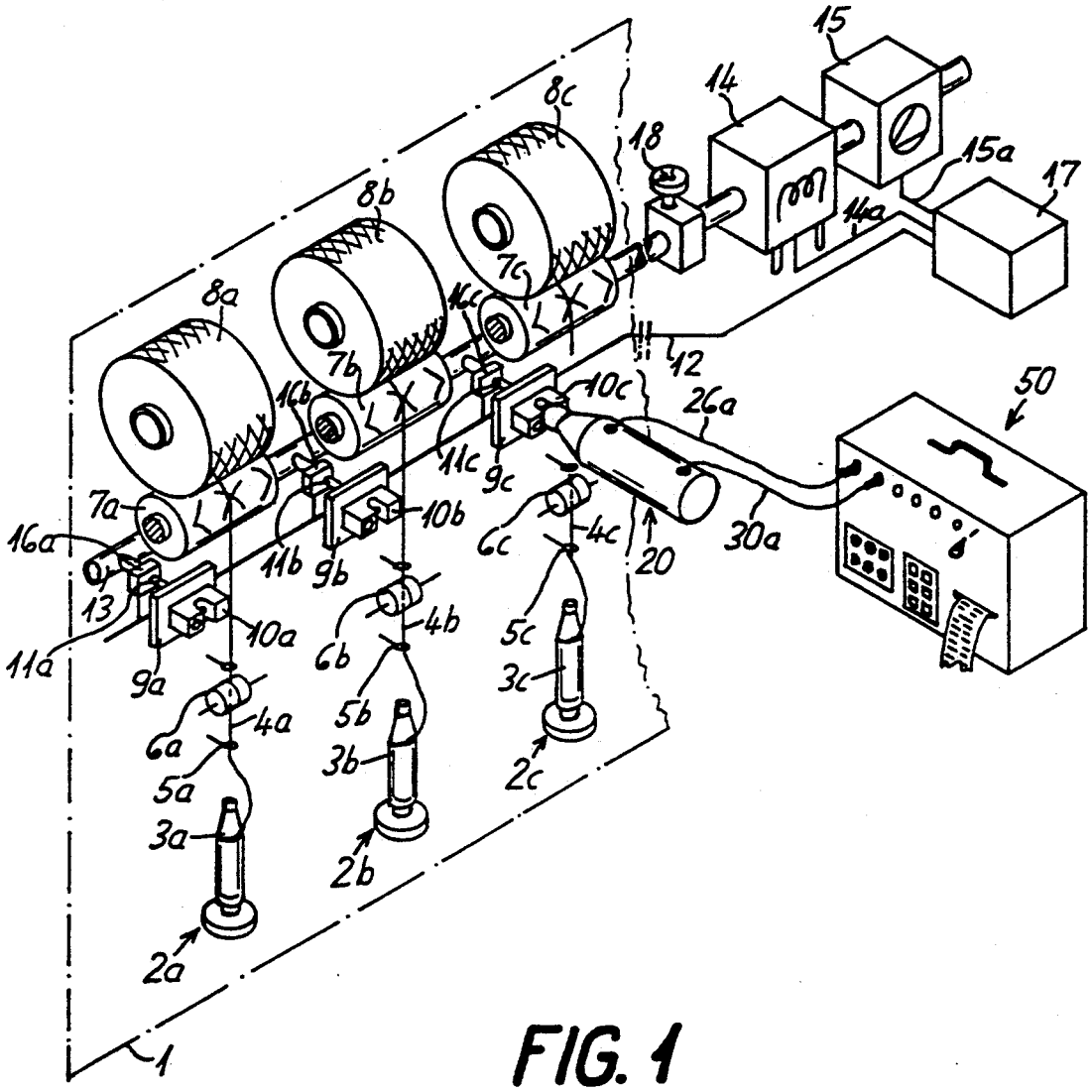
FIG. 1 is a fragmentary, diagrammatic, perspective view illustrating the use of an apparatus according to the invention at a winding station of a winding machine.

Referring now to the figures of the drawings in detail and first, particularly, to FIG. 1 thereof, there is seen an illustration of the way in which the apparatus of the invention can be used at the winding stations of a textile machine, which in this case is a bobbin winding machine.

Reference numeral 1 indicates a winding machine having winding stations. Only three winding stations 2*a*, 2*b* and 2*c* are shown. Only the parts of the winding machine and the winding stations that are essential to a comprehension of the invention are shown.

At the winding stations 2*a*, 2*b* and 2*c*, spinning bobbins 3*a*, 3*b* and 3*c* are in an unwinding position. Yarns or threads 4*a*, 4*b* and 4*c* each travel through a respective balloon breaker 5*a*, 5*b* and 5*c* and through a respective following yarn tensioner 6*a*, 6*b* and 6*c*. While the yarn travel is interrupted at the winding station 2*c*, at the winding stations 2*a* and 2*b*, the yarns are each carried from a respective yarn guide drum 7*a* and 7*b* onto respective cross-wound bobbins or cheeses 8*a* and 8*b*. Although there is also a cheese 8*c* on the yarn guide drum 7*c*, at the moment the yarn travel thereto has been interrupted.

A respective splicer 9*a*, 9*b* and 9*c* is provided at each of the winding stations. There is no need to show a splicer in detail herein, because it is already known from the prior art. The most important characteristic of a splicer is the splicer head. The splicer heads are merely suggested in this case and identified by reference numerals 10*a*, 10*b* and 10*c*.

A respective splicing gas feed line 11*a*, 11*b* and 11*c* leads to each of these splicer heads. These splicing gas feed lines communicate with a central pressure line 13, which extends along all of the winding stations and supplies all of the splicers centrally. The splicing gas is produced in a compressor 15, which is followed by a heat exchanger 14. Such a heat exchanger 14 is needed whenever so-called thermal splicing is performed, that is splicing with heated splicing gas. The pressure of the splicing gas that is to be applied to each splicer head for the splicing procedure can be set at an adjusting valve 18.

A respective actuating valve 16*a*, 16*b* and 16*c* is incorporated into each of the splicing gas feed lines 11*a*, 11*b* and 11*c*. The actuating valves are connected to a signal and control line 12 that leads to a control unit 17. This control unit triggers the actuating valve at the winding station at which a yarn break has been reported and a splicing procedure is intended. At the same time, the control unit 17 can monitor the function of both the compressor 15 and the heat exchanger 14 over lines 14*a* and 15*a*. If the pressure of the splicing gas, or its required temperature, drops below a specific predetermined value, an alarm is sounded and/or the machine is shut off.

At the winding station 2*c*, an apparatus 20 according to the invention for monitoring the operation of the pneumatic splicer, is connected upstream of the splicer head 10*c* of the splicer 9*c*. Status variables monitored by the apparatus 20 are delivered to a computer 50 over signal lines 26*a* and 30*a*. At the computer 50, the status variables are compared with reference values, and deviations from these reference values are ascertained and stored in memory for the output of a log and are finally printed out. The current measured values at any given time can be visibly displayed on a display field.

FIG. 2 shows a portion of FIG. 1, specifically the winding station 2*c*, where the test apparatus 20 according to the invention is connected to the splicer head 10*c* of the splicer 9*c*.

The test apparatus 20 includes a measuring tube 21 which has a conically tapered portion 21*a* and an adaptor 22 disposed upstream of the portion 21*a* for connection to the splicer heads. The adaptor 22 is interchangeable and therefore has a thread 23 with which it can be screwed into the conically tapered portion 21*a* of the measuring tube. Since there are different models of splicer heads, each adaptor is constructed in such a way as to fit a particular model splicer head. With the aid of adaptors, it is possible to connect the measuring tube to different types of splicer heads. The adaptor may be made of a material having low thermal conductivity. This is advantageous for the thermal splicer, because then the heat is not transmitted to the measuring instrument. An uncontrolled transfer of heat would adulterate the outcome of measurement, because the splicer head would cool down.

The front of the adaptor 22 may be lined with an elastic material 24, where it rests against the applicable splicer head. This elastic material can serve to seal off any gaps that may appear if the end surface of the adaptor does not rest flatly against the splicer head. In the present exemplary embodiment, the adaptor is secured with a screw 25 to the splicer head 10*c*. The screw 25 may be constructed in such a way that it always remains on the adaptor and it is connected to it in such a way that it cannot fall out. In order to connect the test apparatus, it need merely be screwed into a threaded blind bore provided on the splicer head.

This exemplary embodiment of the fastening can also be replaced with other types of fastenings. For instance, it would be conceivable to slip the adaptor onto a dovetail guide provided on the splicer head. An important factor in the test to be performed is that the adaptor be connectable as rigidly as possible to the splicer head. The pressure surges that occur during splicing should not be capable of lifting the test apparatus away from the splicer head, which would cause a gap between the splicer head and the adaptor through which the splicing gases could escape. That would produce incorrect measurement results.

The splicer head 10*c* to which the test apparatus 20 is connected, is only diagrammatically illustrated herein. The splicer head 10*c* is secured to the base plate of the splicer 9*c* with a screw 104, and is centered by a connection neck 103. The sectional portion of FIG. 2 shows a splicing conduit or channel 101, which has a circularly grooved bottom. Splicing gas injection openings 102*a* and 102*b* discharge into the grooved bottom in such a manner as to be parallel to one another but offset in height. The two splicing gas injection openings communicate with the common connection neck 103, which extends all the way through the base plate of the splicer 9*c* and to which the splicing gas feed line 11*c* is connected. The actuating valve 16*c*, which can be triggered for actuation through the signal and control line 12, is located in the splicing gas feed line 11*c*.

When the adaptor 22 of a test apparatus 20 is connected to a splicer head, the conditions that prevail during actual splicing can be produced with this adaptor. For instance, if the splicer contains yarn guide baffles that cover the upper and lower openings of the splicing conduit, then in the simulated splicing procedure for testing the splicer, they must also cover the openings of the splicing conduit. If this is not possible, for instance because these yarn guide baffles are attached to parts of the splicer that cannot be actuated during the test procedure, then these yarn guide baffles must be replaced with metal sheets attached to the adaptor, in a non-illustrated manner.

The internal structure of the test apparatus 20 depends on the status variables of the splicing gas that are to be measured. In the present exemplary embodiment shown in FIG. 2, the test apparatus includes a temperature sensor 26 and a flow rate meter 30 such as an anemometer for gases. The temperature sensor 26 is disposed at the tip of the conically tapered portion 21*a* of the measuring tube. In order to increase the area of contact with the air sweeping past it, the temperature sensor 26 is in intimate contact with a sheet-metal strip 27, which extends over the cross section of the measuring tube and extends in its longitudinal direction. The anemometer 30 is disposed at the end of the measuring tube 21. A wind wheel 31 of the anemometer 30 faces the splicing conduit 101. The measuring tube 21 has a rearward end 32 which is open over the entire cross-sectional area thereof, so that the splicing gas can emerge unhindered.

The measuring tube 21 has even more built-in fixtures. In order to measure the flow speed of the splicing gas, the anemometer 30 requires a laminar flow. A turbulent flow, as is produced in the splicing conduit, would lead to an uncontrolled rotation of the wind wheel 31. For this reason, spin brakes 28 are built into the conically tapered portion 21*a* of the measuring tube. The spin brakes are metal sheets that are placed crosswise on one another and extend over the entire length of the conically tapered portion 21*a*. The disposition of the spin breaks 28 can be seen from FIG. 2*a*, which is a section through the conically tapered portion, perpendicular to the longitudinal axis thereof. A plurality of sieves 29 that are disposed in a line at the transition from the measuring tube 21 to the conically tapered portion 21*a*, cancel out the last remaining eddy currents. A turbulent flow or eddy current directly downstream of the splicing conduit 101, which is indicated by an arrow 33 as is shown in the sectional view of the adaptor 22, turns into a laminar flow inside the measuring tube 21, as indicated by arrows 34.

As mentioned above, the computer 50 is used in order to evaluate the various status variables. The temperature sensor 26 is connected to the computer over the signal line 26*a*, and the anemometer 30 is connected to the computer over the signal line 30*a*. The computer has inputs 51*a*–51*e* for the various measurable status variables. The inputs can be activated with respective switches 52*a*–52*e*, once the computer has been switched on with a main switch 53. Instead of individual inputs for the measured values of the various status variables, it is also possible to provide a multi-pole plug having poles which are each connected to the various signal lines. The computer also has a display field 54 for displaying the current measured values. An input keyboard 55 is also provided, with which the reference values can be stored in memory and other functions can be called up. A measurement log with the output of the current measured values and showing the deviation from the reference values, can be output through a printer 56. Naturally, the embodiment of the computer is not restricted to the exemplary embodiment shown. It is also possible to shift the evaluation of the measured values to the main computer of the machine and to perform the evaluation there. Personal computers or laptops that are available on the market are also suitable for evaluating the measured values.

The method of the invention for checking the operation of a pneumatic splicer proceeds as follows:

First, the status variables that are to be tested, such as pressure and temperature, are measured and stored in memory in the computer 50 with the test apparatus 20 at a splicer that furnishes ideally spliced joins. These measured values are the reference values.

Then the test apparatus 20 is connected to one of the pneumatic splicers to be checked, which in the present exemplary embodiment is the splicer 9*c*. At this splicer, the actuating valve 16*c* is actuated for the same period of time as the actuating valve of the reference splicer during the measurement of the reference values. A prerequisite for checking the operation of all of the pneumatic splicers that are connected to the same compressed air source, is that measurement be performed under identical conditions. In other words, at each splicer, the actuating valve must always be actuated for the same period of time.

The signal for the actuating valve can be provided by the control unit 17 through the signal line 12. During this defined period of time, in which the actuating valve 16c is opened, the splicing gas flows through the splicing gas feed line 11c, through the connection neck 103 and through the two splicing gas injection openings 102a and 102b into the splicing conduit 101. Due to the disposition of the splicing gas injection openings and the structure of the splicing conduit, an eddy current arises inside the splicing conduit. This eddy current 33 is propagated in the adaptor 22 and it is converted into a laminar flow 34 in the conically tapered portion 21a, by means of the built-in fixtures, in other words the spin brake 28, as well as by the sieves or sieve package 29. This flow drives the wind wheel 31 and the anemometer 30 measures a certain flow speed of the splicing gas that escapes through the opening 32 in the rearward end of the measuring tube 21. The measured value is input over a signal line 30a to the computer 50, which stores it in memory, simultaneously compares it with the reference value, and ascertains the difference from the reference value. This difference makes it possible to draw conclusions as to whether or not the splicing gas is flowing into the splicing conduit with the pressure that was set at the adjusting valve 18.

Since the splicers are to be operated with a heated splicing gas in the present exemplary embodiment, the temperature of the splicing gas is simultaneously checked by the test apparatus. As the heating splicing gas flows past the sheet 27, the sheet is heated and the temperature increase is measured by the temperature sensor 26. This measured value is likewise supplied to the computer 50 over the signal line 26a, and in the computer it is again stored in memory and compared with the reference value and the corresponding difference is ascertained. The increase in temperature over time and the temperature value attained, provide information as to whether or not the inflowing splicing gas has the temperature required for the splicing procedure.

The status variables should not be understood as absolute values. For instance, the temperature measured with the temperature sensor in the measuring tube is not the actual temperature prevailing in the splicing conduit. Due to the turbulence and outflow and the briefness of time during which the airflow sweeps past the sheet 27, the true temperature of the splicing gas cannot be measured. The same is true for the flow rate of the gas. From it, conclusions can merely be drawn as to the pressure conditions inside the splicing conduit. However, since the measurements are always performed under the same conditions, deviations in the measured values provide an indication as to whether a pneumatic splicer is operating correctly or incorrectly. The accuracy of the measurement can be increased even further by specifying a longer time than the actual actuation time of the actuation valve. As a result, the splicing duration of a few milliseconds can be prolonged. This also makes it possible to measure a more pronounced temperature increase, if heated splicing gas is used for splicing. By repeating the measurement with the same splicer, it is naturally possible to make a better evaluation of the accuracy of the measured values.

If the flow speed of the splicing gas drops notably as compared with the reference value, the conclusion can be drawn that either the splicer is not screwed tightly enough, so that leakage occurs where the splicing gas is introduced, or the leakage may be located in the feed line of the splicing gas leading to the splicer, or the splicing conduit has become dirty, so that the splicing gas injection openings are plugged up.

If the measured temperature increase over the period of time remains below the reference value, then the surroundings of the splicer should be examined for disturbing air flows that cool down the splicer head. If a drop in temperature of the splicing gas is ascertained over the entire machine, then the temperature specification at the heat exchanger is too low. If the splicer heads each have their own heater, which already keeps the splicer at an operating temperature, then a deviation of the measured temperature from the reference value indicates a failure of the splicer head heater.

If the flow speed of the splicing gas flowing out of the splicer head is measured at a splicer, the measured value only indirectly indicates the pressure conditions prevailing in the splicing conduit. Instead of the flow speed of the splicing gas, the pressure brought about by the gas during the splicing procedure can also be measured. To this end, a pressure meter would be built into the measuring tube 21, instead of an anemometer. In FIGS. 3 and 4, two different pressure meters are shown. The structure and mode of operation thereof will be described briefly below.

The features of the test apparatus of FIG. 3 and of the test apparatus of FIG. 2 that match one another are identified by the same reference numerals. The apparatus of FIG. 3 has a different construction inside the measuring tube 21. The built-in fixtures for canceling out the air spin are absent from the conically tapered portion 21a of the measuring tube. A piston 60 moves in the cylindrical part of the measuring tube 21. In a position of repose, the piston 60 is located at the transition between the conically tapered portion of the measuring tube and the cylindrical portion. The piston closes off the entire measuring tube. A piston rod 61 extends through a further piston 62 located downstream of the piston 60. The piston 62 also closes off the measuring tube completely, but like the piston 60 it can move back and forth within it. Between the two pistons 60 and 62 is a compression spring 63. The piston 62 can be moved back and forth by an adjusting device 64, so that the spring 63 can be more or less prestressed. The adjusting device 64 extends through a back wall 65 of the closed measuring tube.

The piston 60 is displaced to the right counter to the force of the spring 63, by means of the splicing gas flowing in through the adaptor 22. The piston rod 61 is displaced in this process as well. Since the distance that the piston 60 travels at various pressures varies in proportion to these pressures, the piston rod 61 can actuate a travel pickup 66, which is not shown in detail in this case but is known from the prior art. This travel pickup 66 is located between the back wall 65 and the piston 62. In order to enable the air in the measuring tube 21 between the pistons 60 and 62 to escape during a measurement procedure, openings 67 are made in the jacket or wall of the measuring tube 21.

The sensitivity of the test apparatus can be adjusted within a certain pressure range with the adjusting device 64. This makes it possible to test various predetermined pressures of the splicing gas. If the spring is relatively taut, higher pressures can be measured. It is also known from the prior art to pickup the distance traveled by an actuated piston over time. Accordingly, it would additionally be possible with this apparatus to ascertain whether or not the specified actuation time of the actuating valve 16 is set exactly, through the use of the distance traveled by the piston during the actuation time.

The measured value of the travel pickup and possibly the stopping time that the piston 60 requires to travel the distance, are fed over a signal line 66*a* to the computer 50, which is not shown in this case. Only plugs 51*a'* and 51*c'* for the intended inputs are shown herein at the signal lines 26*a* and 66*a*.

In addition to the pressure, the temperature of the splicing gas can also be measured with this test apparatus. However, reference is made to the description of FIG. 2 for this feature, since this process has already been explained in detail in the description of the apparatus of FIG. 2.

FIG. 4 shows a further embodiment of the test apparatus, with which the pressure of the outflowing splicing gas can be measured. The pressure measurement is performed with a different instrument than that of FIG. 3. The pressure pickup of the test apparatus 20 in the exemplary embodiment of FIG. 4 is a piezo crystal 70. Pressure pickups of this kind are also known from the prior art and therefore need not be described in detail in this case. In the present exemplary embodiment, the pressure pickup 70 is supported centrally in the measuring tube 21 by a holder 71. Since no temperature measurement of the splicing gas is made in the present exemplary embodiment, the measuring tube 21 can be kept quite short, and also does not need any conically tapered portion. The adaptor 22 is adjoined by a cylindrical measuring tube 21 into which the holder 71, with the piezo crystal 70 resting thereon, is inserted. Upstream of the piezo crystal 70, is a diaphragm 72 that is fixedly installed in the measuring tube 21. Upstream of the diaphragm are outlet openings 73 for the escape of the splicing gas. An opening 74 is also provided between a cap 75 that closes off the measuring tube 21 and the diaphragm 72, for purposes of pressure equalization.

During the splicing procedure that is simulated for test purposes, the diaphragm 72 is pressed against the piezo crystal 70 by the pressure of the splicing gas. The pressure measured with the aid of such a piezo pressure meter gives an indication as to the operation of the splicer being tested. The measured value is delivered over a signal line 70*a* to the computer 50, which is not shown in this case. Only a connection plug 51*d'* for the input provided on the computer, is shown herein.

As in the previous exemplary embodiments, the measured values of the pressure pickup 70 can be viewed only in connection with the reference value of a properly operating splicer. The differences ascertained with the pressure pickup allow conclusions to be drawn as to the operation of the pneumatic splicer and thus as to the quality of the spliced joints being made.

It would also be conceivable to measure the pressure by means of strain gauges which would, for instance, be glued to a sheet-metal strip disposed in the measuring tube, and the bending of which as a result of the splicing gas pressure surge would be measured. The sheet-metal strips can at the same time lead to a thermal element and can thus be used for temperature measurement.

The exemplary embodiment of FIG. 5 is equivalent to that of FIG. 2, except that in addition, the temperature of the splicer head can be measured. The adaptor 22 has an additional temperature sensor 40. The temperature sensor 40 protrudes from the surface with which the adaptor rests on the splicer head 10*c*. The temperature sensor 40 extends all the way through the elastic liner 24 on the contact surface. The temperature sensor 40 may also be constructed in such a way that it protrudes somewhat from the contact surface and yields resiliently when pressed, so that a flush contact with the splicer head is possible.

With the aid of such a temperature sensor, it is possible to ascertain the rise in temperature of a splicer head during a splicing procedure with heated splicing gas. Above all, it must be noted with repeated actuation of the splicer in succession, undesirable overheating of the splicer head can occur. Therefore, if the splicer has no monitoring devices, such as a temperature sensor on the splicer head, the outcomes of splicing may be distorted considerably. With the aid of the test apparatus of FIG. 5, it is possible to ascertain a number of acceptable thermal splices without undesirable overheating of the splicer head. For the most accurate possible ascertainment of the temperature in the region of the splicing conduit, it is naturally important for the additional temperature sensor to come into contact with the splicer head as close as possible to the region of the splicing conduit.

In order to increase the measurement accuracy, it would even be possible to have the measurement sensor protrude from the contact surface and plunge into a bore in the splicer head.

The measured values of the additional temperature sensor 40 are likewise carried over the signal line 40*a* to the computer 50, which is not shown in this case. Once again, a connection plug 51*e'* for connection to the intended input on the computer is shown herein.

We claim:

1. A method for checking the operation of a pneumatic splicer at a textile machine, the pneumatic splicer having a splicer head with a splicing conduit for joining two yarn ends and a splicing gas injection opening for injecting splicing gas into the splicer head, the splicing conduit being means for receiving the injected splicing gas injected through the injection opening, the method which comprises:

feeding splicing gas for a predetermined period of time to a splicer to be checked for splicing a particular yarn batch without having yarn ends laid in place in the splicing conduit of the splicer head of the splicer to be checked;

measuring at least one status variable of the injected splicing gas at a location downstream of the injection opening during the predetermined period of time;

measuring a reference value at another splicer identical to the splicer to be checked, the other splicer producing replicable spliced joints meeting a previously defined quality, by feeding splicing gas to the other splicer without yarn ends being laid in place in the splicing conduit and measuring the reference value of injected splicing gas at a location downstream of the injection opening;

comparing the at least one status variable with the measured reference value and ascertaining deviations;

using the magnitude of the deviations as a basic criterion for evaluating the operation of the splicer to be checked; and, if the splicer does not meet a predetermined condition for satisfactory operation, brining the checked splicer into the condition for satisfactory operation.

2. The method according to claim 1, which comprises measuring the pressure building up upon outflow of the splicing gas at the given opening in the splicer head as the at least one status variable, by positioning splicing gas carrying means at the given opening, delivering the splicing gas to a pressure measuring instrument, and comparing the measured value with a reference value.

3. The method according to claim 1, which comprises measuring the flow speed of the outflowing splicing gas at the given opening in the splicer as the status variable, by positioning splicing gas carrying means at the given opening, delivering the splicing gas to an instrument for measuring the flow speed, and comparing the measured value with a reference value.

4. The method according to claim 1, which comprises measuring the temperature of the outflowing splicing gas at the given opening in the splicer head as the status variable, by positioning splicing gas carrying means at the given opening, delivering the splicing gas to a temperature measuring instrument, and comparing the measured value with a reference value.

5. The method according to claim 1, which comprises simultaneously measuring two status variables of the splicing gas, the status variables being the pressure building up and the temperature of the outflowing splicing gas at the given opening in the splicer head, by positioning splicing gas carrying means at the given opening, carrying the splicing gas to instruments for measuring the status variables, and comparing the at least two status variables with the reference values associated with the at least two status variables.

6. The method according to claim 5, which comprises additionally measuring the temperature of the splicer head.

7. In a pneumatic splicer having a splicer head with a splicing gas injection opening formed in the splicer head for injecting splicing gas into the splicer head and a splicing conduit formed in the splicer head for joining two yarn ends at a textile machine, the splicing conduit being means for receiving injected splicing gas from the injection opening, an apparatus for checking the operation of the pneumatic splicer, comprising a test apparatus having splicing gas carrying means in the form of a measuring tube; and an adaptor carried by said measuring tube for connecting said measuring tube to one of the splicer heads of the splicers; said measuring tube including means for detecting at a location downstream of the injection opening at least one status variable of the injected splicing gas injected into the splicing conduit.

8. The apparatus according to claim 7, wherein said detecting means are in the form of a pressure pickup.

9. The apparatus according to claim 7, wherein said detecting means are in the form of a flow rate meter for gas.

10. The apparatus according to claim 9, including means disposed upstream of said flow rate meter for canceling a spin of the splicing gas in said measuring tube.

11. The apparatus according to claim 7, wherein said detecting means are in the form of a temperature sensor.

12. The apparatus according to claim 11, including a metal sheet oriented in the longitudinal direction of said measuring tube for enlarging on area of contact with the gas flow, said temperature sensor for the splicing gas being secured to said metal sheet.

13. The apparatus according to claim 7, wherein said detecting means are in the form of two means for detecting the pressure building up and the temperature of the outflowing splicing gas.

14. The apparatus according to claim 13, wherein said test apparatus has a further temperature sensor for measuring the temperature of the splicer head.

15. The apparatus according to claim 7, including signal lines connected to said detecting means, and a computer connected to said signal lines for displaying and storing at least one measured value in memory and comparing the at least one measured value with at least one respective predetermined reference value.

16. The apparatus according to claim 7, wherein said adaptor has means for connecting said measuring tube to different splicer heads of various splicers.

17. The apparatus according to claim 16, wherein said adaptor is interchangeable with an adaptor for connecting a different splicer head of a different splicer apparatus.

18. The apparatus according to claim 17, wherein said adaptor is formed of a material with low thermal conductivity.

19. The apparatus according to claim 16, wherein said adaptor is formed of a material with low thermal conductivity.

20. The apparatus according to claim 7, wherein said adaptor is interchangeable with an adaptor for connecting a different splicer head of a different splicer apparatus.

21. In a pneumatic splicer at a textile machine, the pneumatic splicer having a splicer head with a splicing gas injection opening formed therein for injection splicing gas into the splicer head, and with a splicing conduit formed in the splicer head for receiving splicing gas injected through the injection opening, an apparatus for checking the operation of the pneumatic splicer, comprising a test apparatus having splicing gas carrying means in the form of a measuring tube; and an adaptor carried by said measuring tube for connecting said measuring tube to the splicer heads of the pneumatic splicer; said measuring tube including means for detecting at a location downstream of the injection opening at least one status variable of the splicing gas injected into the splicing conduit.

* * * * *